US009903119B2

(12) United States Patent
Tadros et al.

(10) Patent No.: US 9,903,119 B2
(45) Date of Patent: Feb. 27, 2018

(54) FLANGE-TO-FLANGE CONNECTION OF PRECAST CONCRETE MEMBERS

(71) Applicant: e.Construct.USA, LLC, Omaha, NE (US)

(72) Inventors: Maher K. Tadros, Omaha, NE (US); Amgad F. Morgan-Girgis, Omaha, NE (US)

(73) Assignee: e.Construct.USA, LLC, Omaha, NE (US)

( * ) Notice: Subject to any disclaimer, the term of this patent is extended or adjusted under 35 U.S.C. 154(b) by 0 days.

(21) Appl. No.: 15/139,173

(22) Filed: Apr. 26, 2016

(65) Prior Publication Data

US 2016/0319544 A1 Nov. 3, 2016

Related U.S. Application Data

(60) Provisional application No. 62/154,288, filed on Apr. 29, 2015.

(51) Int. Cl.

| | |
|---|---|
| ***E04C 3/00*** | (2006.01) |
| ***E04C 5/16*** | (2006.01) |
| ***E04H 6/08*** | (2006.01) |
| ***E04H 15/62*** | (2006.01) |
| *E04C 3/20* | (2006.01) |
| *E04B 5/04* | (2006.01) |

(52) U.S. Cl.

CPC ..... *E04C 5/162* (2013.01); *E04H 6/08* (2013.01); *E04H 15/62* (2013.01); *E04B 5/04* (2013.01); *E04C 3/20* (2013.01)

(58) Field of Classification Search

CPC ..... E04C 5/162; E04C 3/34; E04C 3/20
USPC ..... 52/838, 835, 297
See application file for complete search history.

(56) References Cited

U.S. PATENT DOCUMENTS 6,138,309 A * 10/2000 Tadros ..... E01D 1/005 14/22
6,219,989 B1 * 4/2001 Tumura ..... E04B 1/2403 52/274
6,453,636 B1 * 9/2002 Ritz ..... E04H 12/2292 52/835
7,253,786 B1 * 8/2007 Logozzo ..... E04H 12/08 343/890
7,832,178 B2 * 11/2010 Rouse ..... E04C 3/34 52/219

(Continued)

*Primary Examiner* — Basil Katcheves
(74) *Attorney, Agent, or Firm* — Suiter Swantz pc llo

(57) ABSTRACT

Flange-to-flange connectors and construction methods using such connectors are disclosed. The connector may include a first and second anchored plates secured to a first and second sets of anchoring bars. The connector may also include a first and second alignment plates configured to mate with the first and second anchored plates. The connector may further include at least one shim configured to be positioned between the first and second anchored plates. A bolt may be configured to secure the first and second alignment plates with the first and second anchored plates, respectively, and when the bolt is tightened, the bolt pulls the first and second alignment plates and the first and second anchored plates together to form a rigid connection, which may eliminate the need to form and cure concrete at job sites, allowing the time, cost, and construction complexity to be reduced significantly compared to conventional connection systems.

13 Claims, 8 Drawing Sheets

(56) References Cited

U.S. PATENT DOCUMENTS

| | | | | |
|---|---|---|---|---|
| 8,191,332 | B1 * | 6/2012 | Semaan | E02D 5/60<br>174/45 R |
| 2004/0020158 | A1 * | 2/2004 | Kopshever, Sr. | E04C 3/30<br>52/835 |
| 2011/0002744 | A1 * | 1/2011 | Tadros | E02D 5/523<br>405/232 |
| 2015/0322665 | A1 * | 11/2015 | Kinnunen | E04B 1/215<br>52/297 |

* cited by examiner

FLANGE-TO-FLANGE CONNECTION OF PRECAST CONCRETE MEMBERS

CROSS-REFERENCE TO RELATED APPLICATIONS

The present application claims the benefit under 35 U.S.C. § 119(e) of U.S. Provisional Application Ser. No. 62/154,288, filed Apr. 29, 2015. Said U.S. Provisional Application Ser. No. 62/154,288 is hereby incorporated by reference in its entirety.

TECHNICAL FIELD

The present disclosure generally relates to the field of construction and more particularly to connection of precast concrete members.

BACKGROUND

A double tee beam is a load-bearing structure that resembles two T-beams connected to each other side by side. The strong bond of the flange (horizontal component) and the two vertical components (also known as stems) creates a structure that is capable of withstanding high loads while having a long span. Floor systems of modern parking structures, for example, use precast double tee beams, which are joined flange-to-flange using connectors anchored in the flange of the double tee beams, to form an integral multi-beam floor.

A type of conventional flange-to-flange connector uses a thin twisted plate pre-embedded in the flange. Two twisted plates aligned with each other across the gap between double tees are welded together at the jobsite using a loose steel plate to connect the flanges. This type of flange-to-flange connector creates a flexible connection, which has been criticized for lack of fatigue capacity and failure of welds if the welding is not done properly by certified welders. In addition, this type of flange-to-flange connector requires caulking (sealant) to seal the gap between the flange edges, with a life expectancy of five to ten years, thus requiring significant maintenance expenses.

SUMMARY

An embodiment of the present disclosure is directed to an apparatus. The apparatus may include a first anchored plate secured to a first set of anchoring bars and a second anchored plate secured to a second set of anchoring bars. The apparatus may also include a first alignment plate configured to mate with the first anchored plate and a second alignment plate configured to mate with the second anchored plate. The apparatus may further include at least one shim configured to be positioned between the first anchored plate and the second anchored plate. A bolt may be configured to secure the first and second alignment plates with the first and second anchored plates, respectively, and when the bolt is tightened, the bolt pulls the first and second alignment plates and the first and second anchored plates together to form a rigid connection.

A further embodiment of the present disclosure is directed to a structure. The structure may include a first concrete member and a second concrete member connected to the first concrete member utilizing a plurality of connectors. Each connector may include a first anchored plate secured to the first concrete member and a second anchored plate secured to the second concrete member. Each connector may also include a first alignment plate configured to mate with the first anchored plate and a second alignment plate configured to mate with the second anchored plate. At least one shim may be configured to be positioned between the first anchored plate and the second anchored plate, and a bolt may be configured to secure the first and second alignment plates with the first and second anchored plates, respectively, wherein when the bolt is tightened, the bolt pulls the first and second alignment plates and the first and second anchored plates together to form a rigid connection between the first concrete member and the second concrete member.

An additional embodiment of the present disclosure is directed to a method. The method may include: providing a plurality of connectors for connecting a first concrete member to a second concrete member, each of the plurality of connectors comprising a first anchored plate secured to the first concrete member and a second anchored plate secured to the second concrete member; bolting each of the plurality of connectors using a bolt, further comprising: providing a first alignment plate configured to mate with the first anchored plate; providing a second alignment plate configured to mate with the second anchored plate; positioning at least one shim between the first anchored plate and the second anchored plate; and tightening the bolt to pull the first and second alignment plates and the first and second anchored plates together to form a rigid connection between the first concrete member and the second concrete member; and sealing one or more gaps between the first concrete member and the second concrete member.

It is to be understood that both the foregoing general description and the following detailed description are exemplary and explanatory only and are not necessarily restrictive of the present disclosure. The accompanying drawings, which are incorporated in and constitute a part of the specification, illustrate subject matter of the disclosure. Together, the descriptions and the drawings serve to explain the principles of the disclosure.

BRIEF DESCRIPTION OF THE DRAWINGS

The numerous advantages of the disclosure may be better understood by those skilled in the art by reference to the accompanying figures in which.

DETAILED DESCRIPTION

Reference will now be made in detail to the subject matter disclosed, which is illustrated in the accompanying drawings.

Embodiments in accordance with the present disclosure are directed to flange-to-flange connectors for precast concrete members (e.g., double tee beams) and construction methods using such flange-to-flange connectors. The flange-to-flange connectors disclosed herein are easy to install, easy to maintain, and are intended to provide structural performance comparable to monolithically and continuously placed concrete between the stems of precast concrete flanged members. The flange-to-flange connectors disclosed herein also allow for generous construction tolerances and misalignments, which may be appreciated for various reasons.

Referring generally to FIGS. 1 through 6, a flange-to-flange connector 100 configured in accordance with an embodiment of the present disclosure is shown. The flange-to-flange connectors 100 can be utilized to securely join two precast concrete members 102 and 104 together using only bolted connections, effectively eliminating the requirement for certified welders and issues associated with low fatigue capacity of welded connectors and excessive deflections and rotations of the flange edges.

Figure 1:
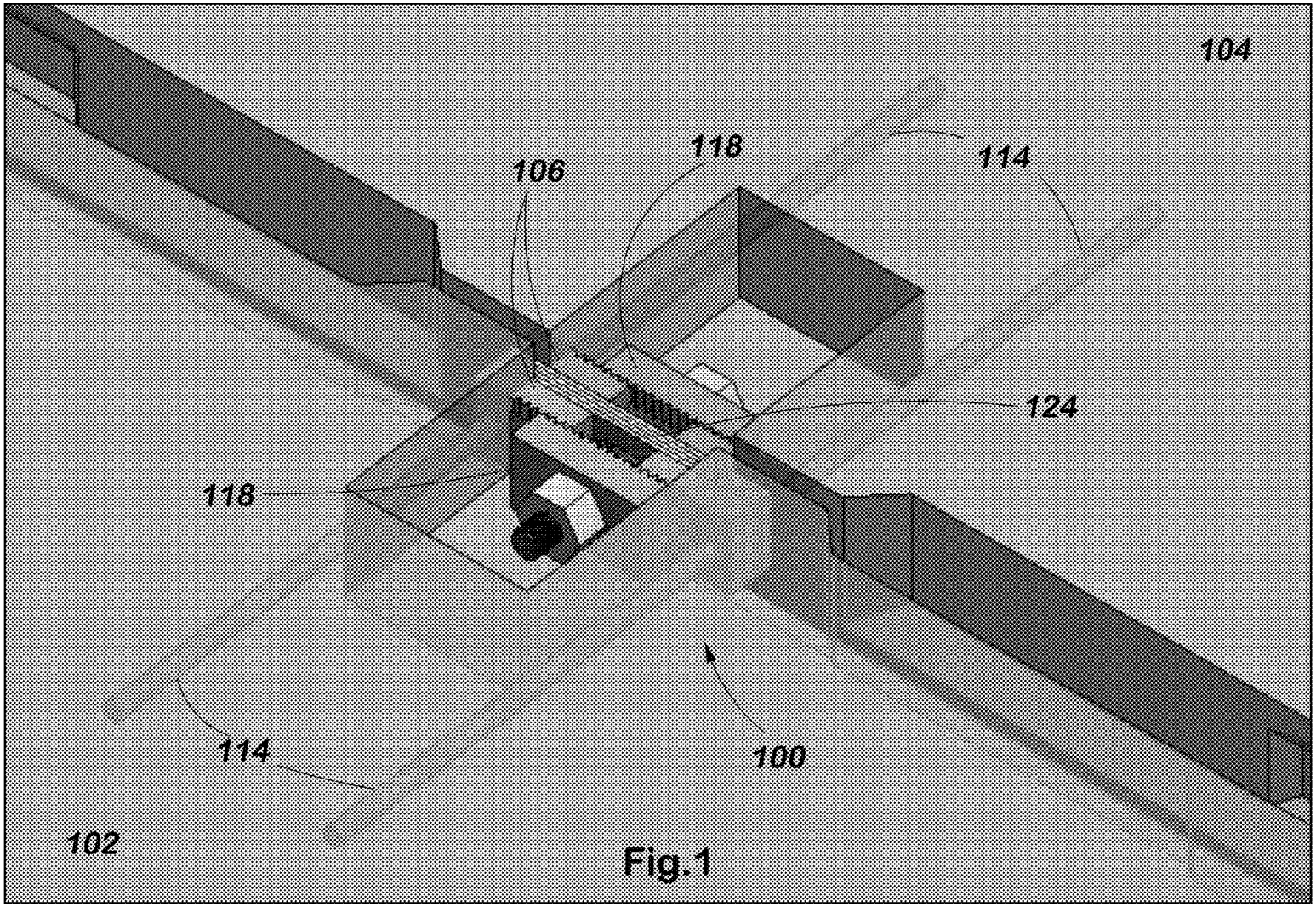
FIG. 1 is an isometric view of a flange-to-flange connector in accordance with the present disclosure.
Figure 2:
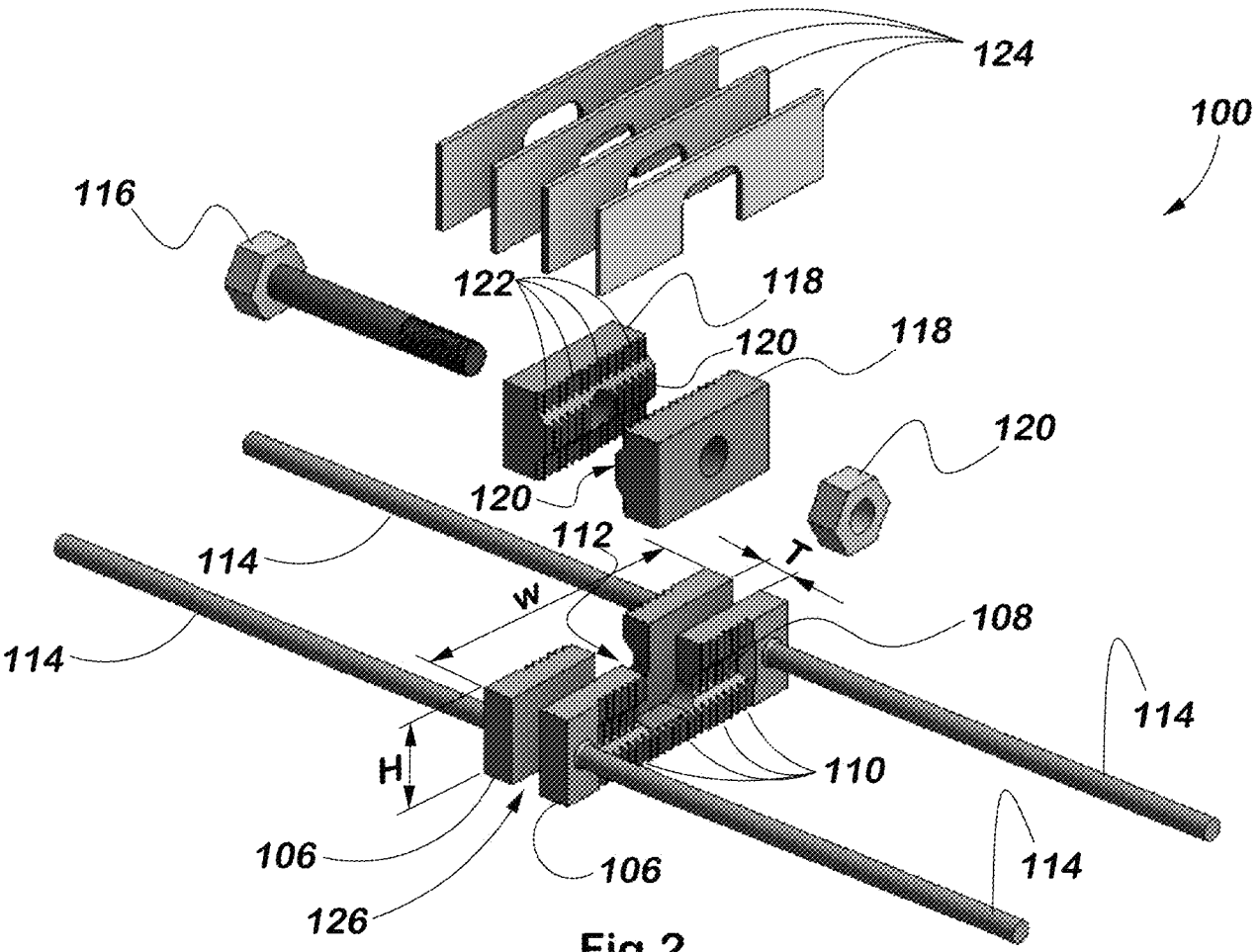
FIG. 2 is an exploded view of a flange-to-flange connector.
Figure 3:
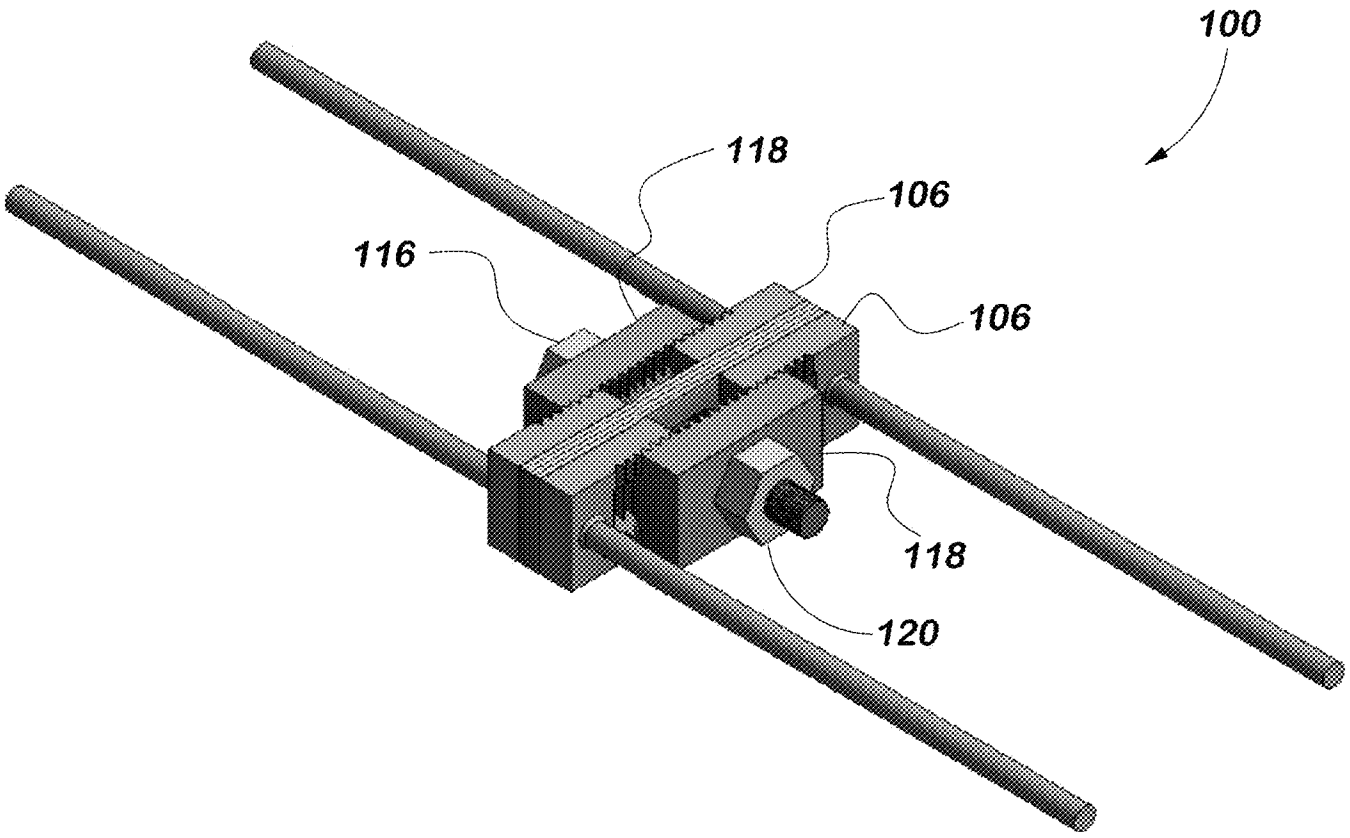
FIG. 3 is an isometric view of the flange-to-flange connector shown in FIG. 2 in a fully assembled configuration.
Figure 4:
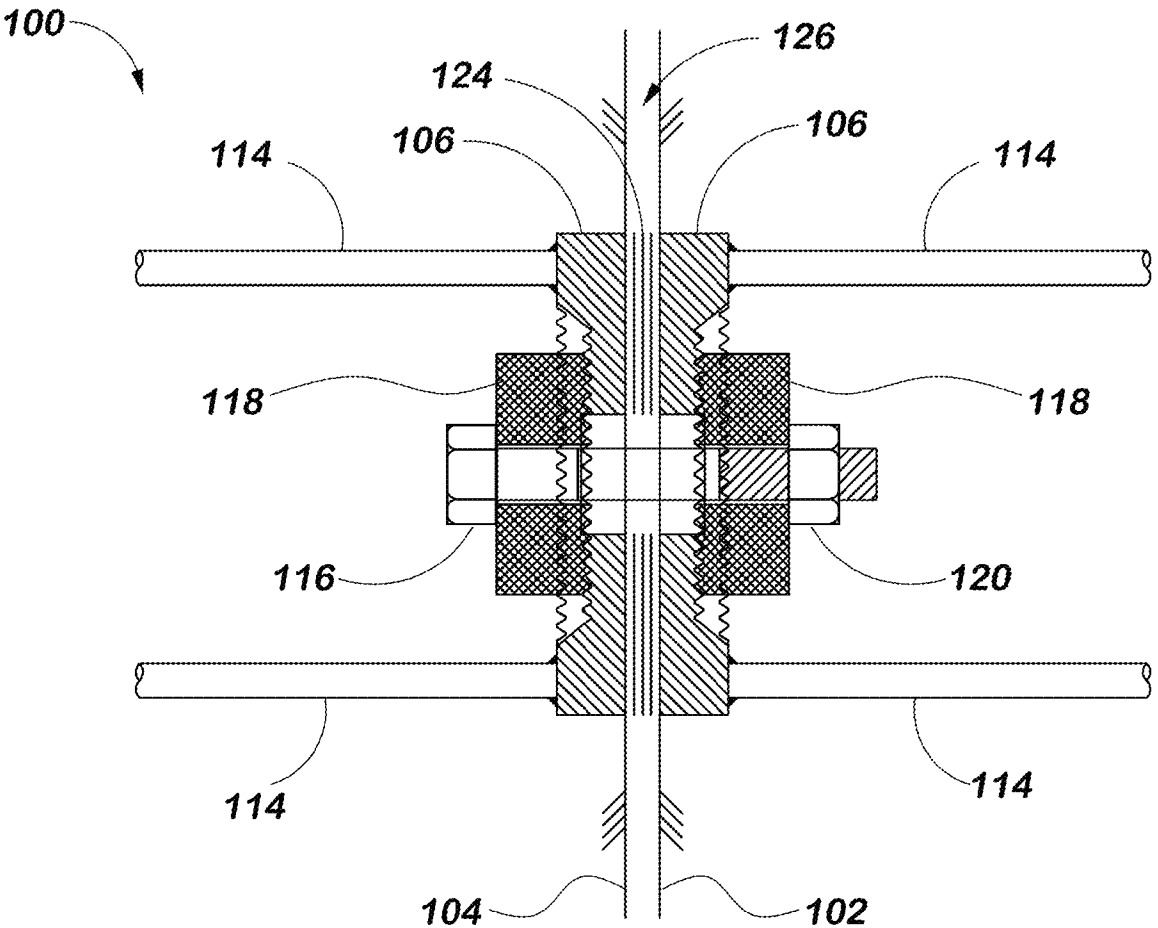
FIG. 4 is a cross-sectional top view of a properly aligned flange-to-flange connector.

As shown in FIGS. 1 and 2, the flange-to-flange connector 100 configured in accordance with the present disclosure includes a pair of anchored plates 106 secured to their respective anchoring bars 114, which are anchored in the precast concrete members 102 and 104. The anchoring bars 114 may be shop-welded (which is a common practice in the precast concrete industry) to the anchored plates 106 in some embodiments. However, if fatigue capacity is a concern, the anchoring bars 114 may be implemented as headed bars, for example, which can be secured to the anchored plates 106 without welding at all. It is contemplated that the anchoring bars 114 may range from approximately ⅜ inches to 1 and ¼ inches in diameter and approximately 12 inches or greater in length. In some embodiments, the anchoring bars 114 may extend the full width of the precast concrete members 102 or 104, and doubly used as the base reinforcement in the flanges. Alternatively, shorter anchoring bars 114 may be utilized to serve similar purposes, as long as the anchoring bars 114 are positioned to create continuity with the flange base reinforcement to allow the tensile forces to be transmitted across the double tee flanges.

The anchored plates 106 may be formed using ductile steel casting, but other techniques and/or materials may be utilized to form the anchored plates 106 without departing from the spirit and scope of the present disclosure. The anchored plates 106 may be configured to satisfy certain structural requirements, so the height, width, and/or the thickness of the anchored plates 106 may vary without departing from the spirit and scope of the present disclosure. In a particular implementation where the flange-to-flange connector 100 is used to connect 4-inch thick flanges for a parking structure, for example, the height of the anchored plates 106 may be configured to be approximately 2 inches to allow for concrete cover of approximately 1 inch on the top and the bottom of the anchored plates 106.

In some embodiments (e.g., as shown in FIG. 2), the anchored plates 106 may define one or more longitudinal indentations (grooves) 108 extending longitudinally (horizontally with respect to the orientation presented in FIG. 2) along at least a portion (e.g., approximately 5 inches along the width) of the anchored plates 106. The anchored plates 106 may also define one or more transverse indentations (teeth) 110 extending transversely (vertically with respect to the orientation presented in FIG. 2) along at least a portion of the anchored plates 106.

The grooves 108 and the teeth 110 may be defined in this manner to help properly and securely receive a pair of alignment plates 118. In some embodiments, the alignment plates 118 may define lugs 120 and teeth 122 that are configured to mate with the grooves 108 and the teeth 110 defined on the anchored plates 106. A bolt 116 and a nut 120 may be utilized to secure the alignment plates 118 against their corresponding anchored plates 106. The bolt 116 may range from approximately ¾ inches in diameter (e.g., ASTM A325 grade 120 ksi) to approximately 1 and ⅜ inches in diameter (e.g., ASTM A490 grade 150 ksi) or greater. The nut 120 may be configured according to the capacity of the bolt 116.

Figure 5:
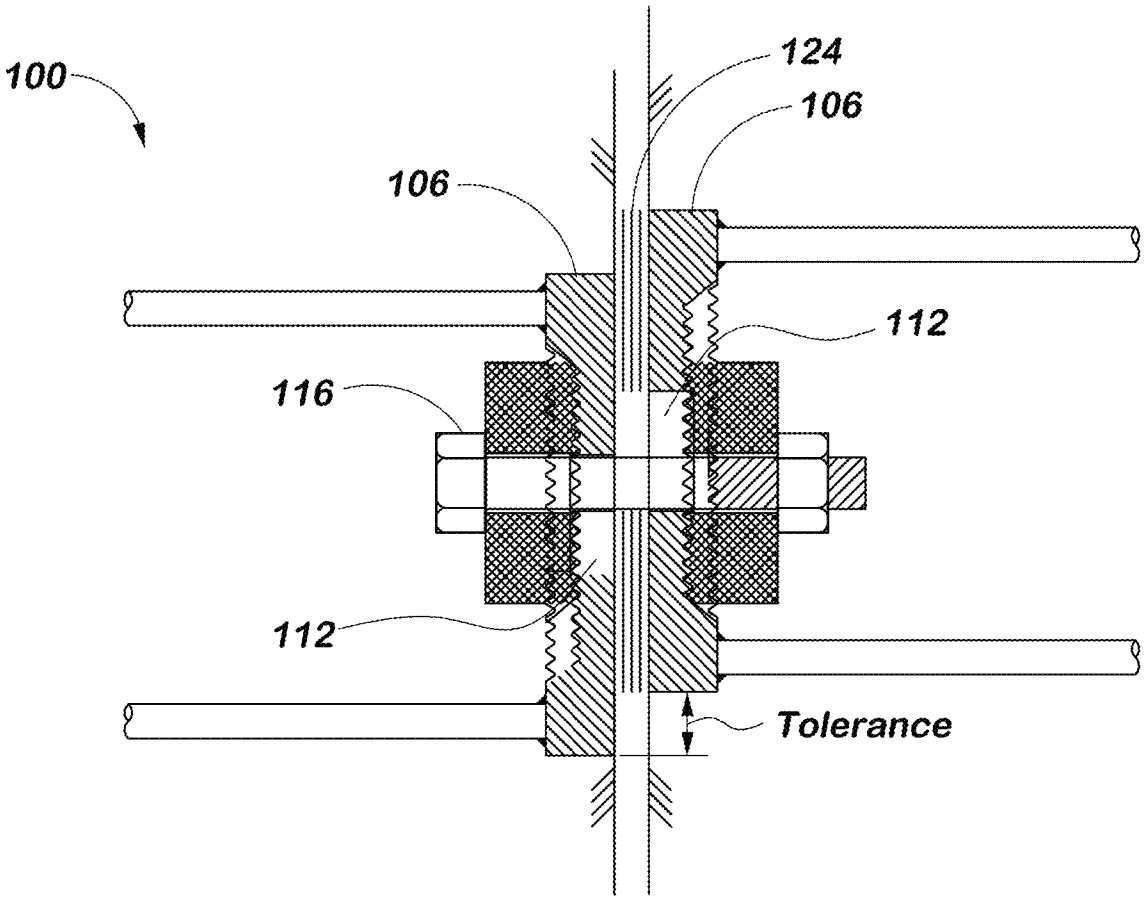
FIG. 5 is a cross-sectional top view of a misaligned flange-to-flange connector due to normal construction tolerances.
Figure 6:
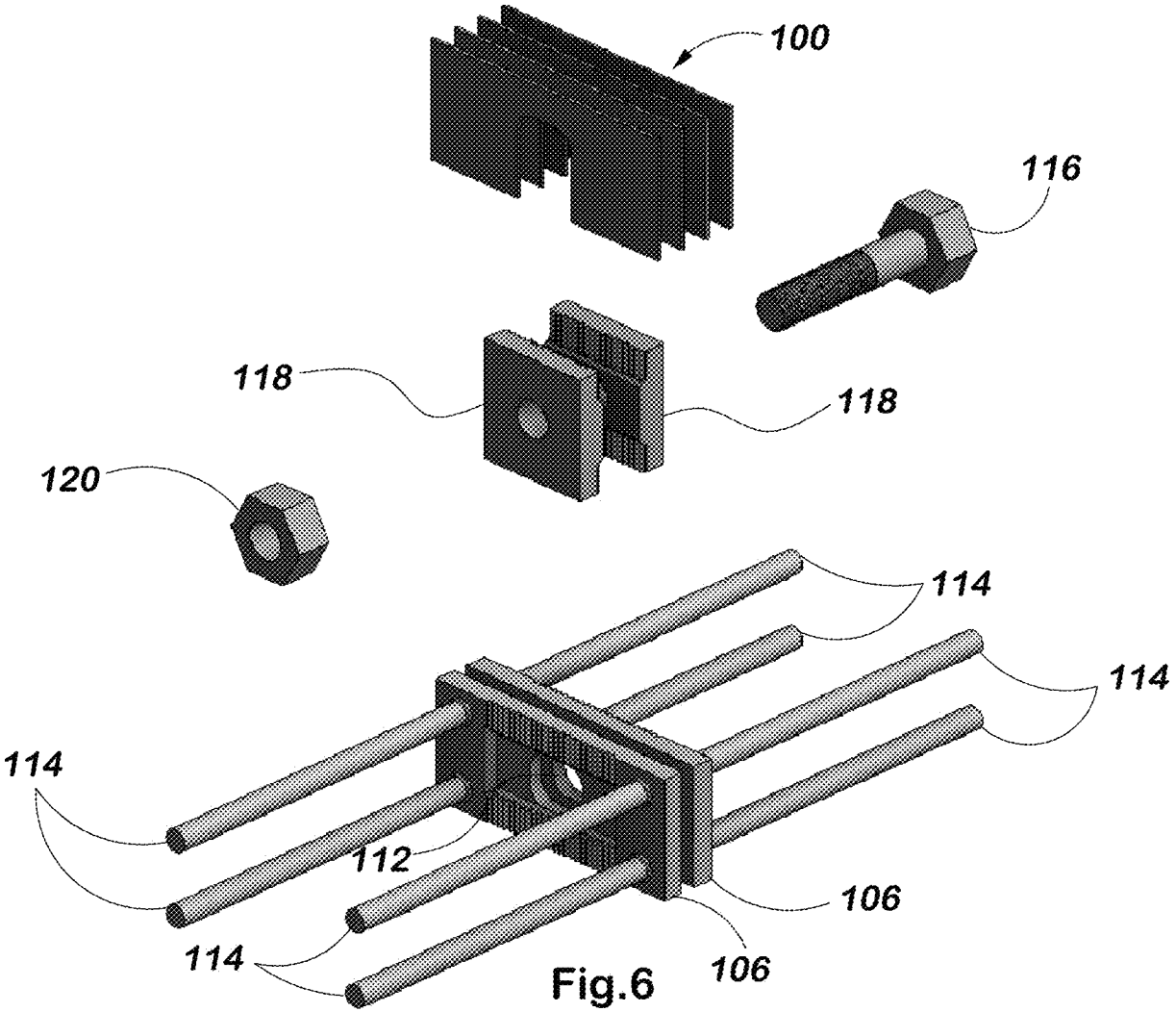
FIG. 6 is an exploded view of a flange-to-flange connector similar to FIG. 2 but for a larger flange and load transfer.

In some embodiments, the anchored plates 106 may define openings 112 that are large enough to accommodate the diameter of the bolt 116. It is contemplated, however, that the openings 112 may be designed to provide a longitudinal tolerance (e.g., an extra inch) in certain embodiments. As shown in FIG. 5, defining the openings 112 with a tolerance effectively allows the flange-to-flange connector 100 to accommodate anchored plate 106 misalignments up to the tolerance provided by the openings 112, which may be appreciated in various applications.

It is also contemplated that the openings 112 may be designed as U-shaped openings, allowing the bolt 116 to be received directly from the top (with respect to the orientation presented in FIG. 2) of the anchored plates 106, which is a feature that may be appreciated in certain (e.g., space-constrained) applications. It is to be understood, however, that the openings 112 are not required to be designed as U-shaped openings. The openings 112 depicted in FIG. 6, for example, do not define U-shaped openings; instead, the openings 112 depicted in FIG. 6 only allows the bolt 116 to be received from the side (with respect to the orientation presented in FIG. 6) of the anchored plates 106.

It is further contemplated that the flange-to-flange connector 100 may be designed to accommodate gaps that may exist between the anchored plates 106. In some embodiments, one or more shims 124 may be utilized to fill such a gap 126. The shims 124 may be made of materials such as hard plastic or the like. As the bolt 116 is tightened, the alignment plates 118, the anchored plates 106, and the shims 124 are all pulled together, effectively forming a rigid connection that provides structural performance comparable to monolithically and continuously placed concrete between the stems of precast concrete flanged members. It is noted that the rigid connections formed using flange-to-flange connectors 100 configured in accordance with the present disclosure eliminate the need to form and cure concrete at job sites, allowing the time, cost, and construction complexity to be reduced significantly compared to conventional construction methods.

Figure 7:
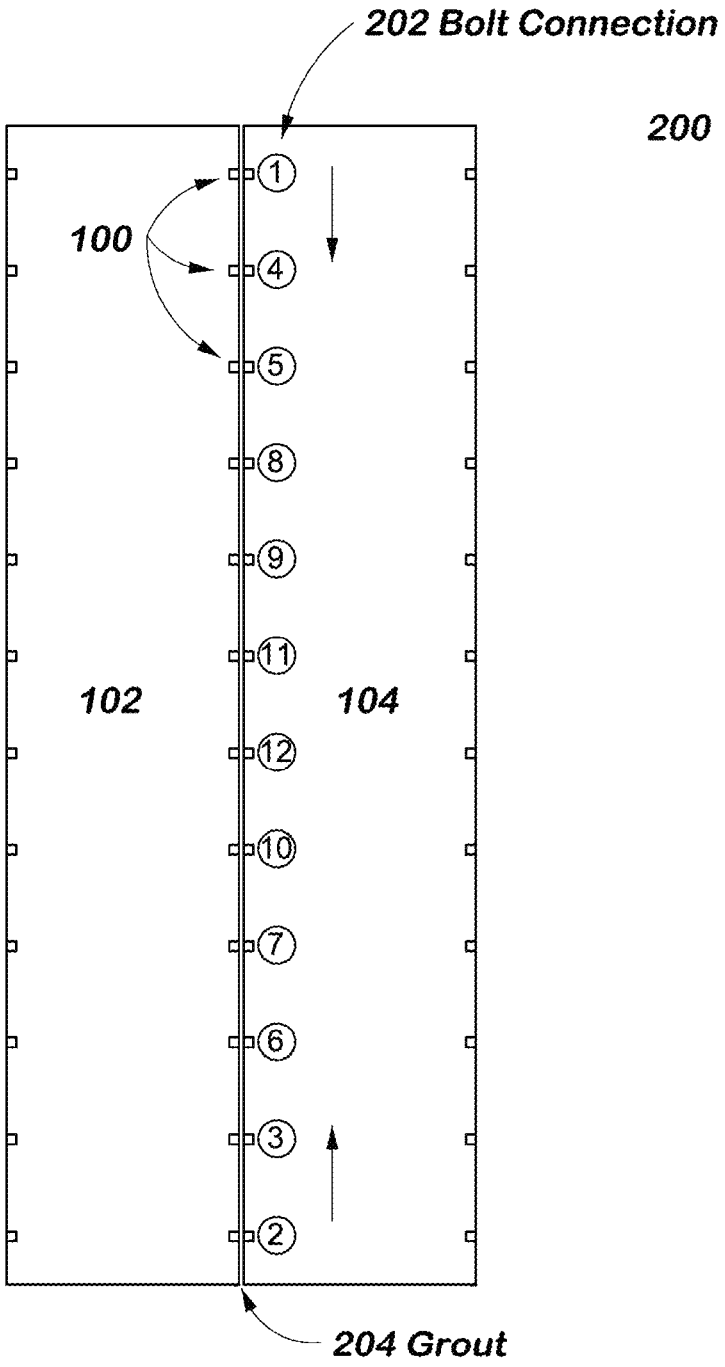
FIG. 7 is an illustration depicting a construction method configured to securely join two precast concrete members using flange-to-flange connectors in accordance with the present disclosure.

Referring now to FIG. 7, a construction method 200 configured to securely join two precast concrete members 102 and 104 using flange-to-flange connectors 100 in accordance with the present disclosure is shown. More specifically, the flange-to-flange connectors 100 located along the two precast concrete members 102 and 104 may be bolt connected in a step 202. It is noted that the step 202 may be carried out according to a particular bolting sequence because even though the two precast concrete members 102 and 104 may be substantially identical, there is still a possibility that the top surfaces of the precast concrete members 102 and 104 may not be exactly aligned at the same elevation at each connection location. It may therefore be appreciated to start the bolting sequence at the opposite ends of the two precast concrete members 102 and 104 and work toward the center. Weights may be applied to the member (102 or 104) located at the higher elevation to force vertical alignment of the two members. The grooves and the lugs previously described will provide the necessary fine tuning of the vertical alignment. Once all the bolts are installed and tightened, another round of tightening may be performed using a technique known as snug tightening.

Figure 8:
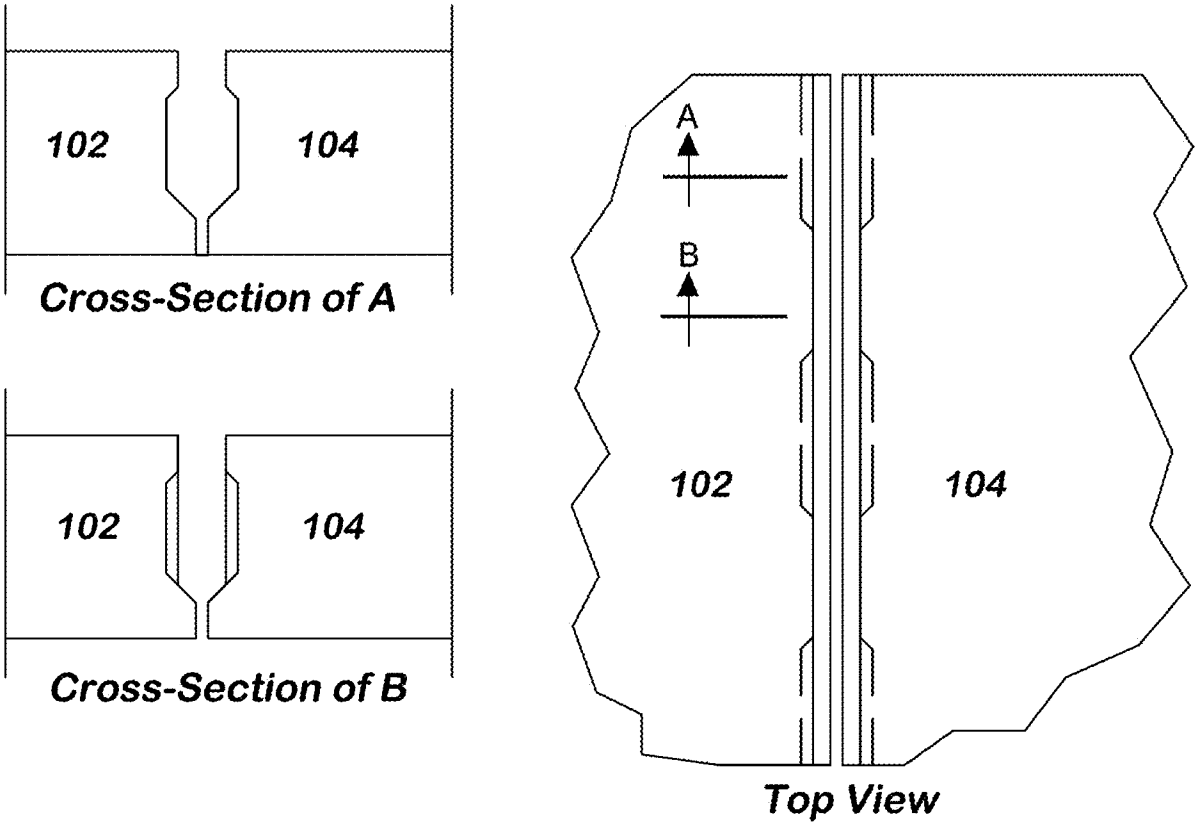
FIG. 8 is an illustration depicting shear keys that may be defined in the gaps between two precast concrete members in accordance with the present disclosure.

After the bolts are adequately snug-tightened, flowable high strength low shrinkage grout may be poured into the gap between the precast concrete members 102 and 104 in a step 204. The bottom of the gap may be filled with backer rod and sealed with a sealant to prevent grout from leaking. In some embodiments, the gap between the precast concrete members 102 and 104 may form (optional) shear keys as depicted in FIG. 8 (and also in FIG. 1). It is contemplated that these shear keys may provide resistance to vertical and longitudinal shear in the plane formed by the precast concrete members 102 and 104.

It is to be understood that while the flange-to-flange connectors 100 configured in accordance with the present disclosure may be utilized for constructing parking structures, the references to parking structures are merely exemplary and are not meant to be limiting. It is contemplated that the flange-to-flange connectors 100 configured in accordance with the present disclosure may be produced in various dimensions, sizes, or shapes for various purposes without departing from the spirit and scope of the present disclosure. It is contemplated that dimensions, sizes, shapes, and hardware implementations of flange-to-flange connectors configured in accordance with the present disclosure may vary from the descriptions above without departing from the spirit and scope of the present disclosure.

The herein described subject matter sometimes illustrates different components contained within, or connected with, different other components. It is to be understood that such depicted architectures are merely exemplary, and that in fact many other architectures can be implemented which achieve the same functionality. In a conceptual sense, any arrangement of components to achieve the same functionality is effectively "associated" such that the desired functionality is achieved. Hence, any two components herein combined to achieve a particular functionality can be seen as "associated with" each other such that the desired functionality is achieved, irrespective of architectures or intermedial components. Likewise, any two components so associated can also be viewed as being "operably connected", or "operably coupled", to each other to achieve the desired functionality, and any two components capable of being so associated can also be viewed as being "operably couplable", to each other to achieve the desired functionality.

It is believed that the present disclosure and many of its attendant advantages will be understood by the foregoing description, and it will be apparent that various changes may be made in the form, construction and arrangement of the components without departing from the disclosed subject matter or without sacrificing all of its material advantages.

What is claimed is:

1. A structure, comprising:

a first concrete member; and a second concrete member connected to the first concrete member utilizing a plurality of connectors, at least one of the plurality of connectors comprising:

a first anchored plate secured to the first concrete member;

a second anchored plate secured to the second concrete member;

a first alignment plate configured to mate with the first anchored plate;

a second alignment plate configured to mate with the second anchored plate;

at least one shim configured to be positioned between the first anchored plate and the second anchored plate; and a bolt configured to secure the first and second alignment plates with the first and second anchored plates, respectively, wherein when the bolt is tightened, the bolt pulls the first and second alignment plates and the first and second anchored plates together to form a rigid connection between the first concrete member and the second concrete member.

2. The structure of claim 1, wherein the first anchored plate is secured to the first concrete member utilizing a first set of anchoring bars and the second anchored plate is secured to the second concrete member utilizing a second set of anchoring bars.

3. The structure of claim 1, wherein the first and second anchored plates each defines at least one longitudinal indentation for mating with at least one lug defined on each of the first and second alignment plates, respectively.

4. The structure of claim 3, wherein the first and second anchored plates each defines a plurality of teeth for mating with a plurality of teeth defined on each of the first and second alignment plates, respectively.

5. The structure of claim 1, wherein the first and second anchored plates each defines an opening large enough to accommodate a diameter of the bolt plus a longitudinal tolerance.

6. The structure of claim 5, wherein the opening is a U-shaped opening.

7. A method, comprising:

providing a plurality of connectors for connecting a first concrete member to a second concrete member, each of the plurality of connectors comprising a first anchored plate secured to the first concrete member and a second anchored plate secured to the second concrete member;

bolting each of the plurality of connectors using a bolt, further comprising:

providing a first alignment plate configured to mate with the first anchored plate;

providing a second alignment plate configured to mate with the second anchored plate;

positioning at least one shim between the first anchored plate and the second anchored plate; and tightening the bolt to pull the first and second alignment plates and the first and second anchored plates together to form a rigid connection between the first concrete member and the second concrete member; and sealing one or more gaps between the first concrete member and the second concrete member.

8. The method of claim 7, further comprising:

securing the first anchored plate to the first concrete member utilizing a first set of anchoring bars when the first concrete member is fabricated; and securing the second anchored plate to the second concrete member utilizing a second set of anchoring bars when the second concrete member is fabricated.

9. The method of claim 7, further comprising:

mating at least one longitudinal indentation defined on each of the first and second anchored plates with at least one lug defined on each of the first and second alignment plates, respectively.

10. The method of claim 7, further comprising:

mating a plurality of teeth defined on each of the first and second anchored plates with a plurality of teeth defined on each of the first and second alignment plates, respectively.

11. The method of claim 7, further comprising:

adjusting the first and second anchored plates with respect to each other within a longitudinal tolerance prior to the bolting step.

12. The method of claim 7, wherein said bolting of the plurality of connectors is performed according to a specific bolting sequence.

13. The method of claim 7, wherein said bolting of the plurality of connectors is performed starting from two opposite ends of the plurality of connectors toward a center.

* * * * *